United States Patent [19]

Hetzer

[11] Patent Number: 4,745,695

[45] Date of Patent: May 24, 1988

[54] INFORMATION CARRIER HOLDING RAIL

[75] Inventor: Norbert Hetzer, Lobbach, Fed. Rep. of Germany

[73] Assignee: Esselte Meto International GmbH, Fed. Rep. of Germany

[21] Appl. No.: 849,280

[22] Filed: Apr. 8, 1986

[30] Foreign Application Priority Data

Apr. 10, 1985 [EP] European Pat. Off. ..... 85104336.4

[51] Int. Cl.[4] ..... G09F 3/18; G09F 7/02

[52] U.S. Cl. ..... 40/10 D; 40/10 R; 40/11 R; 40/611

[58] Field of Search ..... 40/10 B, 10 R, 10 D, 40/591, 593, 611, 11 R, 14

[56] References Cited

U.S. PATENT DOCUMENTS

| | | | |
|---|---|---|---|
| 1,668,429 | 5/1928 | Simon | 40/11 R |
| 2,182,572 | 12/1939 | Schnell | 40/11 R |
| 2,566,837 | 9/1951 | Heulsmeyer | 40/11 R |
| 2,800,732 | 7/1957 | Duran | 40/11 R |
| 3,539,204 | 11/1970 | Keller | 40/10 R |
| 3,553,864 | 1/1971 | Karlyn et al. | 40/10 D |
| 3,889,408 | 6/1975 | Offner | 40/10 R |
| 4,051,615 | 10/1977 | Gosanlso et al. | 40/10 D |
| 4,341,028 | 7/1982 | Brown | 40/11 R |
| 4,449,310 | 5/1984 | Kline | 40/11 R |
| 4,556,183 | 12/1985 | Greenberger | 40/11 R |
| 4,557,064 | 12/1985 | Thompson | 40/10 R |

FOREIGN PATENT DOCUMENTS

| | | | |
|---|---|---|---|
| 3346294 | 6/1984 | Fed. Rep. of Germany | 40/10 R |

*Primary Examiner*—Carl D. Friedman
*Assistant Examiner*—Michael Safavi
*Attorney, Agent, or Firm*—Gerald J. Ferguson, Jr; Michael P. Hoffman; Michael J. Foycik, Jr.

[57] ABSTRACT

An information carrier holding rail (10) which comprises a rear wall (18) and a transparent front wall (12) connected to the rear wall (18) to form an upwardly open pocket. The rear wall (18) and the front wall (12) engage on each other under stress. At the edge of the front wall (12) remote from the connection point (16) between the front wall (12) and the rear wall (18) a grip element (14) projecting from the front wall (12) is disposed.

4 Claims, 3 Drawing Sheets

INFORMATION CARRIER HOLDING RAIL

The invention relates to an information carrier holding rail comprising a rear wall and a transparent front wall connected to the rear wall to form an upwardly open pocket, the rear wall and the front wall being stressed with respect to each other.

Information carrier holder rails of this type are used on racks and shelves in department stores and supermarkets for receiving information carrier signs, labels or tags, for example price tags. The holding rail is usually arranged in the region of the end edge of shelf bottoms and the information carrier tags are inserted into the pocket formed by the front wall and rear wall. U.S. Pat Ser. No. 4,295,288 discloses an information carrier holding rail which is attached by means of a special holder to the respective rack bottom. The holding rail is secured to the holder in such a manner that it projects at the lower end of the holder. When a price tag is to be inserted in the holder rail pressure must be exerted on the downwardly projecting end of the rail so that the front wall is lifted off the rear wall and the tag can either be inserted or removed. There is however a risk that the customer when removing goods from the rack will knock against the projecting portion of the holding rail so that the holding rail possibly becomes detached from its holder when subjected to a violent knock or repeated knocks.

The objective of the invention is to provide an information carrier holding rail which can be easily and conveniently manipulated and can be attached to the end edges of rack bottoms without projection.

This is achieved according to the invention with the features set forth in the characterizing clause of claim 1. With the aid of the grip element projecting from the front wall the front wall can be pulled forwardly so that information carrier tags can be inserted between the front wall and the rear wall or removed from this intermediate space. The provision of the grip element makes it unnecessary for the holding rail to project at its lower end. On the contrary, the holding rail can be attached to the end edges of the rack bottoms in such a manner that knocking against said rail when goods are removed is impossible. The holding rail can also readily be attached to larger surfaces, for example to the panes of glass cases in which goods to be sold are exhibited.

Advantageous further developments of the invention are characterized in the subsidiary claims.

Figure 2:
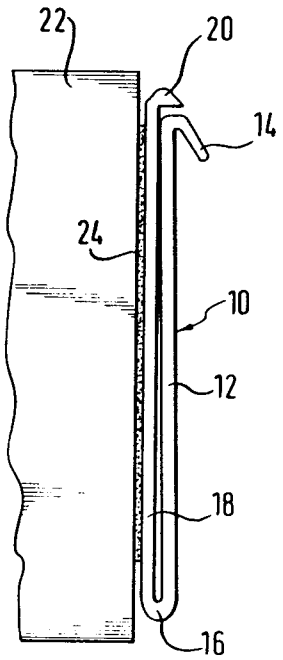
Figure 1:
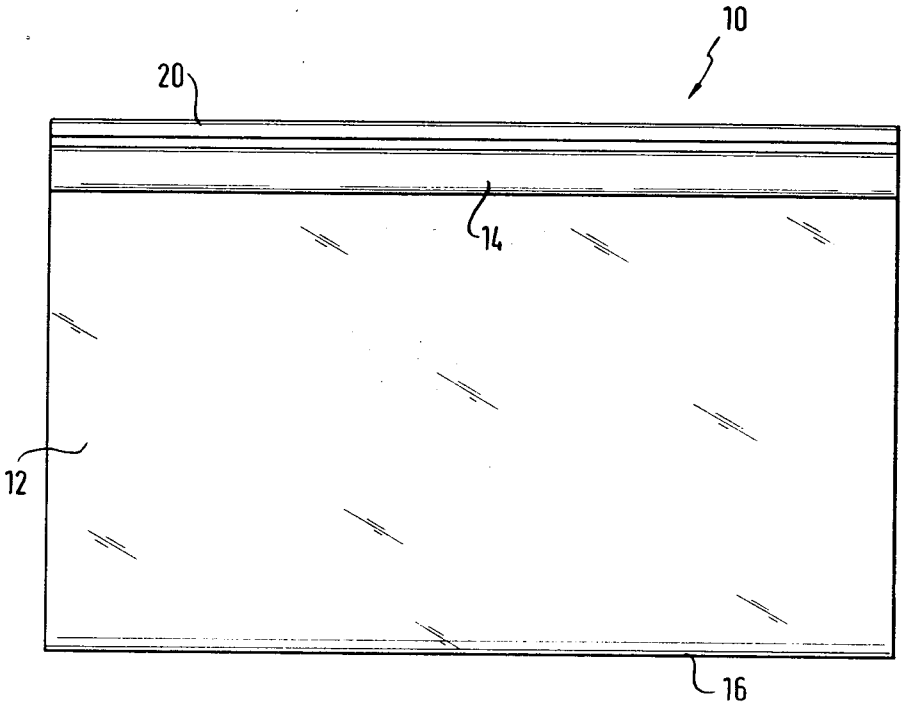
Figure 4:
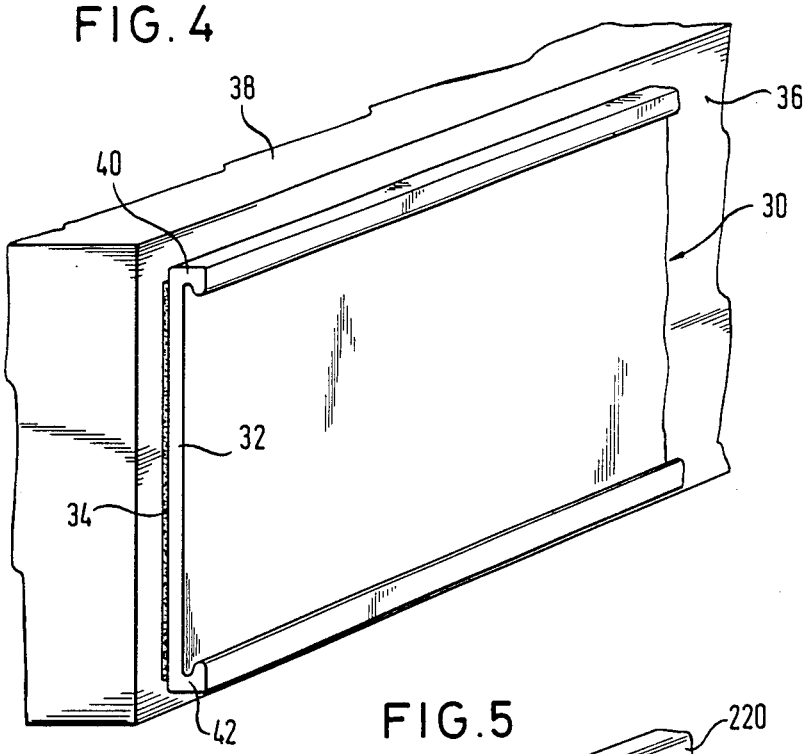
Figure 5:
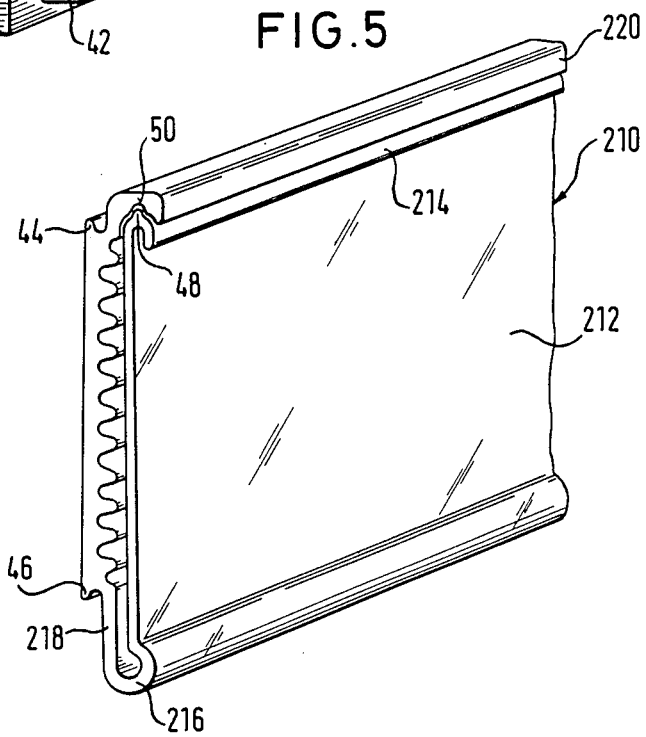
Figure 3:
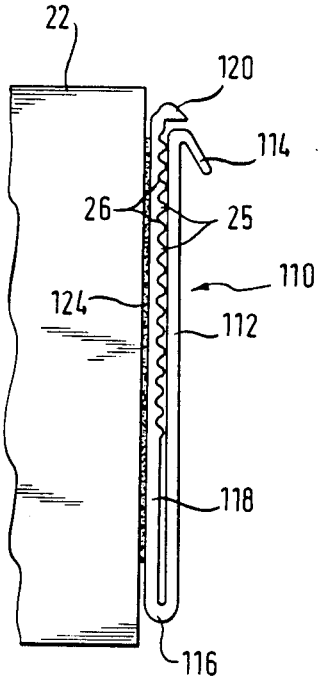

An example of embodiment of the invention will now be explained in detail with reference to the drawings, wherein:

Fig 1 is a front view of an information carrier holding rail according to the invention, FIG. 2 is side view of the holding rail of FIG. 1 with part of the rack bottom to which it is attached, FIG. 3 is another embodiment of the holding rail of FIG. 1 in side view similar to FIG. 2, FIG. 4 is a perspective fragmental view of a rack bottom with a holder attached to the end face thereof for a third embodiment of an information carrier holding rail according to the invention and FIG. 5 shows the third embodiment of the information carrier holding rail in a view similar to FIG. 2.

FIG. 1 shows the information carrier holding rail 10 with its front wall 12 which faces the observer and which is provided at its upper end with a hook 14 serving as grip element. The side view of FIG. 2 shows that the hook is formed by an extension of the front wall 12 which is bent over more than 90°. At the connection point 16 the front wall 12 merges into the rear wall 18. The rear wall 18 projects at the upper end slightly beyond the front wall and it comprises at said projecting end a projection 20 which projects forwardly and covers the gap between the front wall 12 and the rear wall 18. This projection 20 has the function of a roof preventing solid or liquid foreign materials penetrating into the space between the two walls of the holding rail. It can happen in particular when inserting into racks that goods packages tear and the contents drop over the rack edge. The projection 20 deflects the particles or liquids dropping over the edge.

For attaching the holding rail 10 to the end edge of the rack bottom 2 at the back of the rear wall 18 an adhesive layer 24 can be attached which is covered with a protective foil before the attachment. Of course, an adhesive can also be applied in another manner, for example from a tube, to the parts to be adhered.

For inserting or removing an information carrier tag the user grips with his fingertip below the hook 14 and pulls the front wall 12 of the holding rail forwardly. This opens the pocket formed by the front wall 12 and the rear wall to such an extent that insertion or removal of an information carrier tag is readily possible.

In the example of embodiment illustrated the information carrier holding rail 10 is stuck to the end edge of a rack bottom but it can of course also be stuck to any other desired surface, for example to the pane of a glass case in which goods are exhibited for sale.

The information carrier holding rail 10 is made from a polymeric plastic material which is transparent enough for the inscriptions and imprints applied to the information carrier tags to be easily be readable through the front wall even with mobile data pickup devices (scanners).

The holding rail 110 illustrated in FIG. 3 is fundamentally made up like the holding rail of FIG. 1; for this reason the same reference numerals are used for corresponding parts, increased however in each case by one hundred. As a difference to the holding rail 10 of FIG. 1 the rear wall 118 of the holding rail 110 of FIG. 3 comprises at the surface facing the interior of the pocket a region which has a structure formed by protrusions 25 and depressions 26.

It is of no consequence how exactly these protrusions 25 and depressions 26 are formed; the only important point is that zones arise which lie in a lower plane than the protrusions 25. In the embodiment of FIG. 3 the protrusions and depressions follow each other in the form of sinusoidal waves and the protrusions 25 and depressions 26 extend transversely of the height of the holding rail 10; it would however readily also be possible to form the protrusions and depressions in such a manner that they extend in similar undulating succession in each case in the direction of the height of the holding rail 110.

The structure with the protrusions 25 and depressions 26 formed at the rear wall inner surface has the following effect: when an information carrier tag is inserted into the pocket of the holding rail 10' when the pocket is closed it is not in full-surface engagement with the rear wall inner surface but in the region in which the protrusions 25 and depressions 26 are present is in contact with said inner surface only at the peaks of the protrusions 25. When the information carrier tag disposed in the pocket is to be removed after opening said pocket, the tag can be gripped very easily at its upper edge because it detaches itself very easily from the rear wall inner face. With a smooth form of the rear wall inner face this might be more difficult because the information carrier tag then lies very narrowly on the smooth rear wall inner face as if it were stuck thereto. Since however with the holding rail 110 air is present at the points at which the depressions 26 lie between the rear wall and the information carrier tag this sticking effect does not occur and this considerably facilitates removal of the tag.

A third embodiment of the information carrier holding rail 10 will now be explained with reference to FIGS. 4 and 5. The peculiarity of this third embodiment resides in that it is not stuck like the previous embodiments directly to the end edge of the rack bottom but is inserted into its own holder which in turn is attached for example by sticking to the rack bottom edge. FIG. 4 shows in perspective fragmental view such a holder 30 which is provided at its rear wall 32 with an adhesive layer 34 with the aid of which it is secured to the edge 36 of a rack bottom 38. The holder 30 comprises both at its upper and at its lower edge a U-shaped profile 40 and 42 respectively as apparent from FIG. 4. A holder of this type is for example illustrated and described in DE-GM No. 8,411,687.

The information carrier holding rail 210 illustrated in FIG. 5 corresponds in its basic structure to the holding rail 10 of FIG. 1 so that once again for corresponding parts the same reference numerals, increased however by one hundred, have been used. In contrast to the previously described embodiments the holding rail 210 comprises at its rear wall an upwardly projecting hook-like projection 44 and a downwardly projecting hook-like projection 46. The distance between said two projections 44, 46 is so dimensioned that it corresponds exactly to the spacing of the U-shaped profiles 40, 42 of the holder 30. The holding rail 210 can therefore be inserted into the holder 30 in that the projection 44 is inserted beneath the U-shaped profile 40 and the projection 46 then brought by exerting pressure into engagement with the U-shaped profile 42. Since both the holder 30 and the holding rail 210 are made from plastic this engagement of the projection 46 into the U-shaped profile 42 is easily effected.

The embodiment of the holding rail 210 illustrated in FIG. 5 is distinguished by a particular flexibility in its possible uses. For it can easily be cut into smaller length sections each having for example the width of a price tag which is inserted between the front wall 212 and the rear wall 218. If the goods on the rack bottom 38 are moved to another point of the rack bottom the holding rail 210 need not be removed but can be simply displaced in the holder 38 laterally until located beneath the goods to which the price displayed on the price tag in the holding rail 210 applies. The section of the holding rail 210 with the inserted price tag can also be readily removed from the holder 30 and attached to a different rack bottom which is equipped with an identical holder. In these manipulations the price tag disposed in the holding rail 210 is not touched and consequently cannot drop out or be soiled and this is of increasing significance because the price tags frequently also have machine-readable codes in addition to plain writing imprints and said codes are particularly sensitive to smudging or soiling.

In the holding rail 210 of FIG. 5 the projection 220 is drawn somewhat further forwardly over the hook 214 than in the example of embodiment of FIG. 1 in order to obtain a still better covering of the gap between the front wall 212 and the rear wall 218. This also provides a certain clamping effect which results in the front wall 212 being held reliably against the rear wall 218, i.e. the pocket formed by said parts remaining securely closed, even when the connection point 216 no longer has any particular inherent elasticity due to frequent opening of the pocket. To intensify the holding effect at the apex of the hook 214 a web 48 is disposed which in the closed state of the pocket formed by the front wall 212 and the rear wall 218 engages into a groove 50 of the projection 220. Due to the cooperation between the web 48 and the groove 50 there is even a certain detent effect ensuring with particular certainty that the pocket remains closed.

I claim:

1. Information carrier holding rail comprising a rear wall and a transparent front wall connected to the rear wall to from a upwardly open pocket, the front wall having an upper edge, the rear wall and the front wall being resiliently biased toward each other, a grip element being disposed at the upper edge of the front wall remote from a connection point between the front wall and the rear wall projecting from said front wall; the rear wall having a projectin which projects over the grip element of the front wall; the grip member having an uppermost portion having a web thereon; the rear wall projection having an inner surface, said inner surface having a groove therein adapted to receive the web of the uppermost portion of the grip element in engagement therewith.

2. Information carrier holding rail according to claim 1, wherein the grip element is a hook formed at an angle to the edge of the front wall of more than 90°.

3. Information carrier holding rail according to claim 1 or 2, wherein the surface of the rear wall facing the interior of the pocket has a sturcture comprising protrusions and depressions at least in a region near the open end of the pocket to facilitate removal of articles therefrom.

4. Information carrier holding rail according to, claim 1 wherein two hook-like projections are disposed along the rear wall, one of which projects upwardly with the other projecting downwardly, a spacing between the two hook-like projections corresponding to a spacing between two U-shaped profiles on a holder intended to receive the holding rail.

* * * * *